US012203700B2

(12) United States Patent
Durand et al.

(10) Patent No.: US 12,203,700 B2
(45) Date of Patent: Jan. 21, 2025

(54) COOLING AND/OR LIQUEFYING METHOD AND SYSTEM

(71) Applicant: L'Air Liquide, Societe Anonyme pour l'Etude et l'Exploitation des Procedes Georges Claude, Paris (FR)

(72) Inventors: Fabien Durand, Sassenage (FR); Remi Nicolas, Sassenage (FR); Cecile Gondrand, Sassenage (FR); Jean-Marc Bernhardt, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 250 days.

(21) Appl. No.: 17/633,016

(22) PCT Filed: Jul. 8, 2020

(86) PCT No.: PCT/EP2020/069182
§ 371 (c)(1),
(2) Date: Feb. 4, 2022

(87) PCT Pub. No.: WO2021/023457
PCT Pub. Date: Feb. 11, 2021

(65) Prior Publication Data

US 2022/0260310 A1 Aug. 18, 2022

(30) Foreign Application Priority Data

Aug. 5, 2019 (FR) ..... FR 1908950

(51) Int. Cl.
*F25J 1/02* (2006.01)
*F25J 1/00* (2006.01)

(52) U.S. Cl.
CPC ..... *F25J 1/0022* (2013.01); *F25J 1/0037* (2013.01); *F25J 1/005* (2013.01); *F25J 1/0288* (2013.01);
(Continued)

(58) Field of Classification Search
CPC ..... F25J 1/0248; F25J 1/0251; F25J 3/04824; F25J 2280/20; F25J 2280/40
See application file for complete search history.

(56) References Cited

U.S. PATENT DOCUMENTS

2006/0168976 A1 8/2006 Flynn et al.
2010/0275616 A1 11/2010 Saji et al.
(Continued)

OTHER PUBLICATIONS

International Search Report and Written Report for PCT/EP200/069182, mailed Oct. 23, 2020.
French Search Report for FR 1908950, mailed Apr. 1, 2020.

*Primary Examiner* — Brian M King
(74) *Attorney, Agent, or Firm* — Justin K. Murray

(57) ABSTRACT

The invention relates to a method for cooling and/or liquefying a user fluid flow, the method using a cooling and/or liquefying system comprising a low-temperature refrigeration device, the refrigeration device comprising a working circuit forming a loop and containing a working fluid, the refrigeration device comprising a cooling exchanger intended to extract heat from the user fluid flow by heat exchange with the working fluid circulating in the working circuit, the working circuit forming a cycle comprising, in a series: a compression mechanism a cooling mechanism, an expansion mechanism, and a reheating mechanism, the system comprising a pipe for circulation of the user fluid flow to be cooled in heat exchange with the cooling exchanger of the refrigeration device, the method comprising a step of cooling a user fluid flow in the cooling exchanger and after this cooling step, a step of cleaning
(Continued)

impurities solidified in the cooling exchanger, the cleaning step comprising stopping of the refrigeration device and simultaneously, circulation of a user fluid flow in the cooling exchanger.

11 Claims, 1 Drawing Sheet

(52) U.S. Cl.
CPC ..... *F25J 2205/20* (2013.01); *F25J 2280/20* (2013.01); *F25J 2290/34* (2013.01); *F25J 2290/62* (2013.01)

(56) References Cited

U.S. PATENT DOCUMENTS

| | | | | |
|---|---|---|---|---|
| 2011/0197925 | A1* | 8/2011 | Herzog | F28G 15/003 134/184 |
| 2012/0180520 | A1* | 7/2012 | Dickerson | F25J 1/0248 62/606 |
| 2013/0068220 | A1* | 3/2013 | Kudaravalli | F25J 3/04981 128/201.21 |
| 2015/0308734 | A1 | 10/2015 | Bauer | |

* cited by examiner

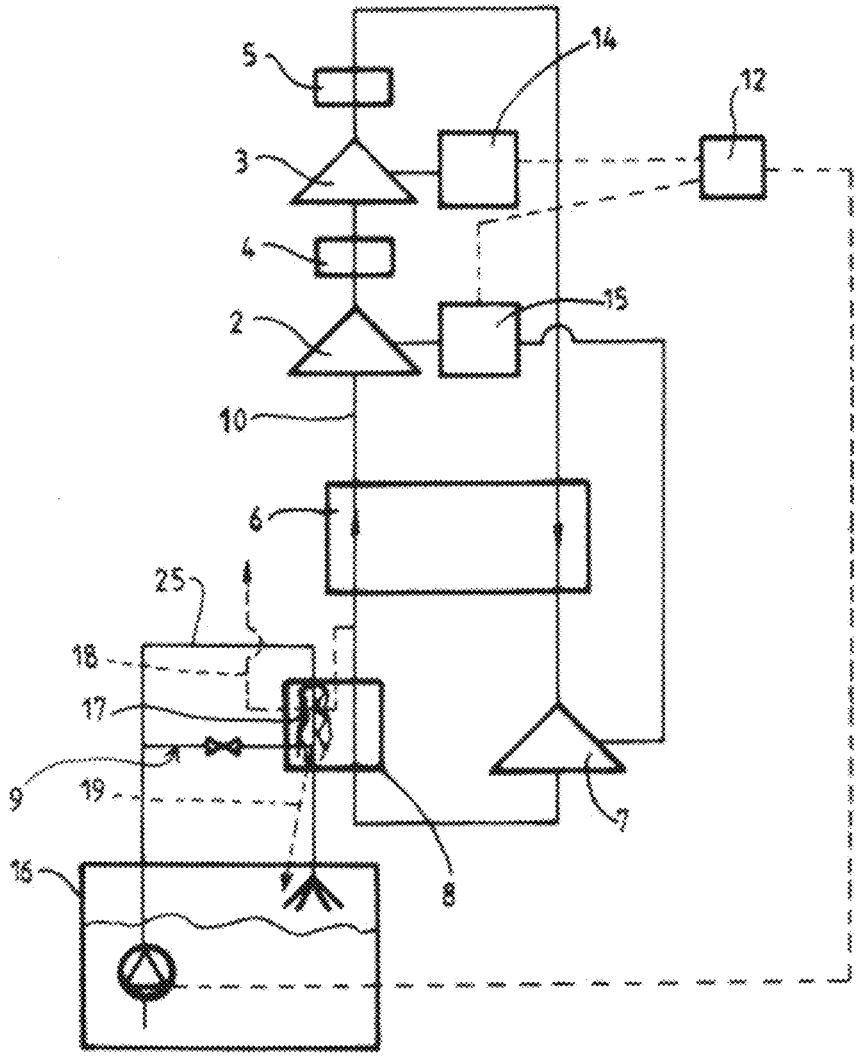
5
14
12
3
4
15
2
10
6
25
18
17
9
19
16
8
7

COOLING AND/OR LIQUEFYING METHOD AND SYSTEM

CROSS-REFERENCE TO RELATED APPLICATIONS

This application is a § 371 of International PCT Application PCT/EP2020/069182, filed Jul. 8, 2020, which claims § 119(a) foreign priority to French patent application FR 1908950, filed Aug. 5, 2019.

BACKGROUND

Field of the Invention

The invention relates to a method and to a system and method for cooling and/or liquefaction.

The invention relates more particularly to a method for cooling and/or liquefying a flow of user fluid, in particular natural gas, the method using a cooling and/or liquefaction system comprising a low-temperature refrigeration device, that is to say for refrigeration at a temperature of between minus 100 degrees centigrade and minus 273 degrees centigrade, in particular between minus 100 degrees centigrade and minus 253 degrees centigrade, the refrigeration device comprising a working circuit forming a loop and containing a working fluid, the refrigeration device comprising a cooling exchanger intended to extract heat from the flow of user fluid by heat exchange with the working fluid circulating in the working circuit, the working circuit forming a cycle comprising, in series: a mechanism for compressing the working fluid, a mechanism for cooling the working fluid, a mechanism for expanding the working fluid, and a mechanism for heating the working fluid, the system comprising a circulation duct for said flow of user fluid to be cooled in heat exchange with the cooling exchanger of the refrigeration device, the method comprising a step of cooling a flow of user fluid in the cooling exchanger and, after this cooling step, a step of cleaning away impurities that have solidified in the cooling exchanger.

The invention relates in particular to cryogenic refrigerators or liquefiers, for example of the type having a "Turbo Brayton" cycle or "Turbo Brayton coolers" in which a cycle gas (helium, nitrogen or another pure gas or a mixture) undergoes a thermodynamic cycle producing cold which can be transferred to a member or a gas intended to be cooled.

Related Art

These devices are used in a wide variety of applications and in particular for cooling the natural gas in a tank (for example in ships). The liquefied natural gas is for example subcooled to avoid vaporization thereof or the gaseous part is cooled in order to be reliquefied.

For example, a flow of natural gas can be made to circulate in a heat exchanger cooled by the cycle gas of the refrigerator/liquefier.

The gas cooled in this exchanger may contain impurities (such as carbon dioxide, etc.), which are likely to solidify at the cold temperatures achieved at the cooling heat exchanger. This can block the heat exchanger and impair the efficiency of the system.

One solution may consist in providing phases in which the heat exchanger is heated actively with an electric heater. This is costly in terms of energy, however, and often unsuitable for explosive atmospheres.

SUMMARY OF THE INVENTION

An aim of the present invention is to overcome all or some of the drawbacks of the prior art that are set out above.

To this end, the method according to the invention, which is otherwise in accordance with the generic definition thereof given in the above preamble, is essentially characterized in that the cleaning step comprises stopping the refrigeration device and, simultaneously, making a flow of user fluid circulate in the cooling exchanger.

Furthermore, embodiments of the invention may include one or more of the following features:

- a flow of user fluid is made to circulate in the cooling exchanger via the circulation duct,
- a flow of user fluid is made to circulate in the cooling exchanger by being pumped from a tank of user fluid,
- the method includes, simultaneously with and/or after the cleaning step, a step of purging the cooling exchanger with a flow of purge fluid injected into the cooling exchanger in order to sweep and evacuate from the cooling exchanger the impurities detached during the cleaning step,
- the purging step comprises the sweeping of the exchanger with a neutral gas which is evacuated to a discharging zone,
- the purging step comprises the sweeping of the exchanger with user fluid,
- the user fluid used in the purging step is taken from the circulation duct,
- the user fluid that has been used for purging the cooling exchanger is evacuated to at least one of: a discharging zone, a tank of the user fluid.

The invention also relates to a system for cooling and/or liquefying a flow of user fluid, in particular natural gas, comprising a low-temperature refrigeration device, that is to say for refrigeration at a temperature of between minus 100 degrees centigrade and minus 273 degrees centigrade, the refrigeration device comprising a working circuit forming a loop and containing a working fluid, the refrigeration device comprising a cooling exchanger intended to extract heat from the flow of user fluid by heat exchange with the working fluid circulating in the working circuit, the working circuit forming a cycle comprising, in series: a mechanism for compressing the working fluid, a mechanism for cooling the working fluid, a mechanism for expanding the working fluid, and a mechanism for heating the working fluid, the system comprising a circulation duct for said flow of user fluid to be cooled in heat exchange with the cooling exchanger of the refrigeration device, the system comprising an electronic controller for controlling the refrigeration device, said controller being configured to switch the refrigeration device into a cooling mode in which the cooling exchanger is cooled by the working gas in order to cool a flow of user fluid or into a stopped mode in which the circulation of the working fluid in the working circuit is interrupted, the electronic controller being configured to switch the system into a configuration for cleaning away impurities that have solidified in the cooling exchanger, in which the refrigeration device is switched into its stopped mode and, simultaneously, a flow of user fluid is made to circulate in the cooling exchanger.

According to other possible particular features:

- the system comprises a purge circuit having an upstream end connected to a source of purge fluid and a downstream end that leads into a discharge zone, the purge circuit passing through the cooling exchanger in order to sweep and evacuate from the exchanger the impurities detached during the cleaning step, the purge fluid comprises a neutral gas or user fluid, the discharge zone comprises a burner, the atmosphere or a tank of user fluid to be cooled.

The invention may also relate to any alternative device or method comprising any combination of the features above or below within the scope of the claims.

BRIEF DESCRIPTION OF THE FIGURES

Further particular features and advantages will become apparent upon reading the following description, which is given with reference to the figures, in which:

FIG. 1 shows a schematic and partial view illustrating the structure and operation of an example of a system that can implement the invention,

DETAILED DESCRIPTION OF THE INVENTION

The cooling and/or liquefaction system in [FIG. 1] comprises a refrigeration device 1 that supplies cold (a cooling capacity) at a cooling exchanger 8. The system comprises a duct 25 for circulation of a flow of fluid to be cooled placed in heat exchange with this cooling exchanger 8. For example, the fluid is liquid natural gas pumped from a tank 16, then cooled (preferably outside the tank 16), then returned to the tank 16 (for example raining down in the gas phase of the tank 16). This makes it possible to cool or subcool the contents and to limit the occurrence of vaporization. To this end, the circulation duct 25 comprises an upstream end connected to the inside of the tank, in particular in the lower part in order to take liquid therefrom, and an upstream end connected to the tank to return the fluid thereto, for example in the upper part. For example, the liquid from the tank 16 is subcooled below its saturation temperature (drop in its temperature of several K, in particular 5 to 20K and in particular 14K) before being reinjected into the tank 16. In a variant, this refrigeration can be applied to the vaporization gas from the tank 16 in order in particular to reliquefy it.

The low-temperature refrigeration device comprises a working circuit 10 (preferably closed) forming a circulation loop. This working circuit 10 contains a working fluid (helium, nitrogen, neon, hydrogen or another appropriate gas or mixture, for example helium and argon or helium and nitrogen or helium and neon or helium and nitrogen and neon).

The working circuit 10 forms a cycle comprising, in series: a mechanism 2, 3 for compressing the working fluid, a mechanism 6 for cooling the working fluid, a mechanism 7 for expanding the working fluid, and a mechanism 6 for heating the working fluid.

The device 1 comprises a cooling heat exchanger 8 intended to extract heat at at least one member 25 by heat exchange with the working fluid circulating in the working circuit 10.

The mechanisms for cooling and heating the working fluid conventionally comprise a common heat exchanger 6 through which the working fluid passes in countercurrent in two separate passage portions of the working circuit depending on whether it is cooled or heated.

The cooling heat exchanger 8 is situated for example between the expansion mechanism 7 and the common heat exchanger 6. As illustrated, the cooling heat exchanger 8 may be a heat exchanger separate from the common heat exchanger 6.

However, in a variant, this cooling heat exchanger 8 could be made up of a portion of the common heat exchanger 6 (meaning that the two exchangers 6, 8 can be in one piece, i.e. may have separate fluid circuits that share one and the same exchange structure).

Thus, the working fluid which leaves the compression mechanism 2, 3 in a relatively hot state is cooled in the common heat exchanger 6 before entering the expansion mechanism 7. The working fluid which leaves the expansion mechanism 7 and the cooling heat exchanger 8 in a relatively cold state is, for its part, heated in the common heat exchanger 6 before returning into the compression mechanism 2, 3 in order to start a new cycle.

Conventionally, in a normal operating mode (the working gas undergoes the cycle of compression, cooling, expansion and heating and produces cold at the cooling exchanger 8), an equal mass flow rate circulates in the two passage portions in the common heat exchanger 6.

Thus, as illustrated, in the normal operating mode, a flow of fluid (liquefied natural gas or the like, in particular hydrogen) can be cooled in the cooling exchanger 8. In the event that this fluid contains impurities (carbon dioxide or the like) that are likely to solidify as they are cooled, a blockage 17 or an obstruction may arise in the cooling exchanger 8.

To evacuate these impurities created during use (for example after several hours or days of cooling), the system may automatically take up or be disposed manually in a cleaning mode for cleaning away impurities that have solidified in the cooling exchanger 8. According to this configuration, the refrigeration device 1 is stopped and simultaneously, a flow of user fluid is made to circulate in the cooling exchanger 8.

The stopping of the refrigeration device 1 will interrupt the production of cold at the refrigeration heat exchanger 8. This heat exchanger 8 will heat up compared with its cooling configuration. This heating combined with the flow of user fluid will evacuate the solidified impurities by sublimation or vaporization and mechanical evacuation. Specifically, the impurities will dissolve in the flow that sweeps them.

This making of a flow of user fluid circulate in the cooling exchanger 8 can be realized by the same circulation duct 25 as feeds the fluid to be cooled, for example by being pumped from a tank 16 to be cooled.

To further improve the efficiency and rapidity of the process, a purge 18 of the cooling exchanger 8 with a flow of purge fluid injected into the cooling exchanger 8 in order to sweep and evacuate from the cooling exchanger 8 the impurities detached during the cleaning step can be provided simultaneously with and/or after the cleaning step.

For example, a circuit 18 of neutral gas or the like (nitrogen for example) may be provided to purge the heated impurities. This purge may, if necessary, replace making the flow of user fluid circulate during heating. The mixture obtained can be evacuated to a discharging zone (to the atmosphere for example).

Alternatively, this purge 18 may be realized with a flow of user fluid. For example, a user fluid fraction is taken from the circulation duct 12 (via a bypass 9 provided with a valve for example). The purge user fluid can vaporize in the cooling exchanger 8 and detach the impurities. The mixture obtained can be sent back to the outside or a collection zone and can, in particular, be reinjected into the tank 16 of user fluid.

The device may comprise at least one electronic controller 12 connected to all or part of the members of the system (motors, valves, pump, etc.). The electronic controller 12 may comprise a microprocessor or a computer and may be configured to control the system, in particular according to the process described above or below.

The compression mechanism 2, 3 comprises one or more compressors and at least one drive motor 14, 15 for rotating the compressor(s) 2, 3, the refrigeration capacity of the device being variable and controlled by regulating the speed of rotation of the drive motor(s) 14, 15 (cycle speed).

In the example depicted, the refrigeration device comprises two compressors that form two compression stages and an expansion turbine. This means that the compression mechanism comprises two compressors 2, 3 in series, preferably of the centrifugal type, and the expansion mechanism comprises a single turbine 7, preferably a centripetal turbine. Of course, any other number and arrangement of the compressor(s) and turbine may be envisioned, for example three compressors in series and one expansion turbine or two compressors in series and two turbines in series or three compressors in series and two or three turbines in series.

In the example illustrated, a cooling exchanger 4, 5 is provided at the outlet of each compressor 2, 3 (for example cooling with heat exchange with water at ambient temperature or any other cooling agent or fluid). This makes it possible to realize isentropic or isothermal or substantially isothermal compression. Of course, any other arrangement may be envisioned (for example no cooling exchanger 4, 5 having one or more compression stages). Similarly, a heating exchanger may or may not be provided at the outlet of all or part of the expansion turbines 7 to realize isentropic or isothermal expansion (before or after the cooling exchanger 8). Also preferably, the heating and cooling of the working fluid are preferably isobaric, without this being limiting.

For example, the device 1 comprises two high-speed motors 14, 15 (for example 10 000 revolutions per minute or several tens of thousands of revolutions per minute) for respectively driving the two compression stages 2, 3. The turbine 7 may be coupled to the motor 2 of one of the compression stages 2, 3, meaning that the device may have a turbine 7 forming the expansion mechanism which is coupled to the drive motor 2 of a compression stage 2 (in particular the first).

Thus, the power of the turbine(s) 7 can advantageously be recovered and used to reduce the consumption of the motor(s). Thus, by increasing the speed of the motors (and thus the flow rate in the cycle of the working gas), the refrigeration capacity produced and thus the electrical consumption of the liquefier are increased (and vice versa). The compressors 2, 3 and turbine(s) 7 are preferably coupled directly to an output shaft of the motor in question (without a geared movement transmission mechanism).

The output shafts of the motors are preferably mounted on bearings of the magnetic type or of the dynamic gas type. The bearings are used to support the compressors and the turbines.

Moreover, all or part of the device, in particular the cold members thereof, can be accommodated in a thermally insulated sealed casing (in particular a vacuum chamber containing the cold parts: cooling exchanger 8, turbine 7, and optionally the common countercurrent heat exchanger).

The invention may apply to a method for cooling and/or liquefying another fluid or mixture, in particular hydrogen.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context dearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A method for cooling and/or liquefying a flow of user fluid, comprising the steps of:

providing a cooling and/or liquefaction system comprising a low-temperature refrigeration device for refrigeration at a temperature of between minus 100 degrees centigrade and minus 273 degrees centigrade, the refrigeration device comprising:

a tank of user fluid, a cooling exchanger configured to cool the flow of user fluid via indirect heat exchange with a working fluid, a working circuit forming a loop and containing the working fluid, the working circuit forming a cycle comprising: one or more compressors configured to compress the working fluid, a cooling line of a working circuit heat exchanger configured to cool the working fluid, a turbine configured to expand the working fluid, a heating line within the cooling exchanger configured to heat the working fluid, and a heating line of the working circuit heat exchanger configured to heat the working fluid; and a circulation duct for said flow of user fluid to be cooled in heat exchange with the cooling exchanger of the refrigeration device;

cooling a flow of user fluid in the cooling exchanger; and after said step of cooling a flow of user fluid, cleaning away impurities that have solidified in the cooling exchanger, said step of cleaning away impurities comprising simultaneously stopping the refrigeration device and making a flow of the user fluid circulate in the cooling exchanger by pumping the user fluid into the circulation duct from a liquid phase of the tank and then return to the tank by raining down into a gas phase of the tank.

2. The method of claim 1, further comprises a step of purging the cooling exchanger with a flow of purge fluid injected into the cooling exchanger in order to sweep and evacuate from the cooling exchanger the impurities detached during the cleaning step, said step of purging the cooling exchanger being performed simultaneously with said step of cleaning away impurities, after said step of cleaning away impurities, or both before and after said step of cleaning away impurities.

3. The method of claim 2, wherein said step of purging the cooling exchanger comprises sweeping the exchanger with a neutral gas which is evacuated to a discharging zone.

4. The method of claim 2, wherein said step of purging the cooling exchanger comprises sweeping the exchanger with the user fluid.

5. The method of claim 4, wherein the user fluid used in the purging step is taken from the circulation duct.

6. The method of claim 5, wherein the user fluid that has been used for purging the cooling exchanger is evacuated to at least one of: a discharging zone, a tank of the user fluid.

7. The method of claim 1, wherein the user fluid is natural gas.

8. A system for cooling and/or liquefying a flow of user fluid, comprising:

a low-temperature refrigeration device for refrigeration at a temperature of between minus 100 degrees centigrade and minus 273 degrees centigrade, the refrigeration device comprising a working circuit that forms a loop and contains a working fluid and a cooling exchanger that is configured to extract heat from the flow of user fluid by heat exchange with the working fluid circulating in the working circuit, the working circuit forming a cycle comprising, in series: one or more compressors configured to compress the working fluid, a cooling line of a working circuit heat exchanger configured to cool the working fluid, a turbine configured to expand the working fluid, a beating line within the cooling exchanger configured to heat the working fluid, and a beating line of the working circuit heat exchanger configured to beat the working fluid;

a tank of user fluid;

a circulation duct for said flow of user fluid to be cooled in heat exchange with the cooling exchanger of the refrigeration device; and an electronic controller for controlling the refrigeration device, said controller being configured to:

switch operation of the refrigeration device into a cooling mode in which the cooling exchanger is cooled by the working gas in order to cool a flow of user fluid or into a stopped mode in which the circulation of the working fluid in the working circuit is interrupted; and switch operation of the system into a configuration for cleaning away impurities that have solidified in the cooling exchange in which the refrigeration device is switched into its stopped mode, and simultaneously, a flow of the user fluid is made to circulate in the cooling exchanger by pumping the user fluid into the circulation duct from a liquid phase of the user tank and return the circulated user fluid to the user tank by raining down into a gas phase of the tank.

9. The system of claim 8, further comprising a purge circuit having an upstream end connected to a source of purge fluid and a downstream end that leads into a discharge zone, wherein the purge circuit passes through the cooling exchanger in order to sweep and evacuate, from the exchanger, the impurities detached during the cleaning step.

10. The system of claim 9, wherein the purge fluid comprises a neutral gas or user fluid.

11. The system of claim 10, wherein the discharge zone comprises a burner, the atmosphere, or a tank of user fluid to be cooled.

* * * * *